US005254269A

United States Patent [19]

Taylor et al.

[11] Patent Number: 5,254,269

[45] Date of Patent: Oct. 19, 1993

[54] FABRIC CONDITIONING COMPOSITION CONTAINING AN EMULSIFIED SILICONE MIXTURE

[75] Inventors: Timothy J. Taylor, Hoboken; Samuel Lin, Paramus, both of N.J.

[73] Assignee: Lever Brothers Company, Division of Conopco, Inc., New York, N.Y.

[21] Appl. No.: 797,841

[22] Filed: Nov. 26, 1991

[51] Int. Cl.[5] ..... D06M 10/08

[52] U.S. Cl. ..... 252/86; 252/8.8; 252/8.9; 252/547; 252/548; 8/115.6; 8/116.1

[58] Field of Search ..... 252/8.6, 8.7, 8.8, 8.9, 252/547, 548, 554; 8/115.6, 116.1

[56] References Cited

U.S. PATENT DOCUMENTS

| | | | |
|---|---|---|---|
| 3,655,420 | 4/1972 | Tichenor | 252/8.6 |
| 3,972,131 | 8/1976 | Rudy | 252/8.6 |
| 4,152,272 | 5/1979 | Young | 252/8.8 |
| 4,421,792 | 12/1983 | Rudy | 252/8.6 |
| 4,446,033 | 5/1984 | Barrat | 252/8.6 |
| 4,661,267 | 4/1987 | Dekker | 252/8.8 |
| 4,661,269 | 4/1987 | Trinh | 252/8.8 |
| 4,724,089 | 2/1988 | Konig | 252/8.8 |
| 4,767,548 | 8/1988 | Kasprzak et al. | 252/8.8 |
| 4,769,159 | 9/1988 | Copeland | 252/8.8 |
| 4,800,026 | 1/1989 | Coffindaffer et al. | 252/8.8 |
| 4,806,255 | 2/1989 | Konig | 252/8.6 |
| 4,818,242 | 4/1989 | Burmeister | 8/115.6 |
| 4,834,895 | 5/1989 | Cook | 252/8.8 |
| 4,846,982 | 6/1989 | Madone et al. | 252/8.8 |
| 4,846,990 | 6/1989 | Upadek et al. | 252/8.8 |
| 4,908,140 | 3/1990 | Bausch et al. | 252/8.8 |
| 4,913,828 | 4/1990 | Caswell | 252/8.8 |
| 5,057,572 | 10/1991 | Chrobaczek et al. | 8/116.1 |
| 5,063,260 | 11/1991 | Chen et al. | 252/8.6 |
| 5,064,544 | 11/1991 | Lin et al. | 252/8.8 |
| 5,071,573 | 12/1991 | Coffindaffer et al. | 252/8.8 |

FOREIGN PATENT DOCUMENTS

| | | |
|---|---|---|
| 0255711 | 2/1988 | European Pat. Off. . |
| 0342834 | 11/1989 | European Pat. Off. . |
| 2172910 | 10/1986 | United Kingdom . |

OTHER PUBLICATIONS

U.S. Ser. No. 07/532,488, Lin et al., filed Jun. 1, 1990.
U.S. Ser. No. 07/532,473, Line et al., filed Jun. 1, 1990.

*Primary Examiner*—Paul Lieberman
*Assistant Examiner*—William S. Parks
*Attorney, Agent, or Firm*—A. Kate Huffman

[57] ABSTRACT

Fabric conditioning compositions comprising an emulsified mixture of a silicone oil and a silicone emulsifier as defined in a hydrocarbon based fabric conditioning agent. The composition may be coated onto tumble dryer sheets or admixed with detergent bases to form washing and conditioning formulations.

19 Claims, No Drawings

FABRIC CONDITIONING COMPOSITION CONTAINING AN EMULSIFIED SILICONE MIXTURE

FIELD OF THE INVENTION

The present invention relates to a fabric conditioning composition having a hydrocarbon-based fabric conditioner agent and an emulsified mixture of a silicone oil with an organo-modified silicone emulsifier. More particularly, it relates to the use of such compositions in tumble dryer articles and fabric detergent formulations.

BACKGROUND OF THE INVENTION

Silicone oils were first used in dryer sheet fabric conditioners as an ironing aid as described in Rudy et al. in U.S. Pat. No. 4,421,711. The inclusion of polydiorganosiloxanes in tumble dryer sheet applications have been shown to improve the anti-static performance of the fabric conditioners as described in Karsprzak et al. in U.S. Pat. No. 4,767,548. Karsprzak discloses the use of polydimethylsiloxanes, polyphenylmethylsiloxanes and dimethylsiloxane-glycol copolymers in its dryer sheet formulations.

Additionally, organo-modified silicones useful as coactives in tumble dryer sheets are disclosed in U.S. Ser. No. 07/532,488 (disclosing alkyl silicones and alkylamino silicones) and U.S. Ser. No. 07/532,473 (disclosing salt complexes of amino silicones combined with Bronsted acids, in particular fatty acids). The use of conventional silicone oils are described in both pending U.S. applications as optional ingredients which may be added to the dryer sheet formulations.

Silicones have been used extensively in aqueous dispersions or rinse-cycle fabric softening compositions as described in Dumbrell et al. in GB 1,549,180; Burmeister et al. in U.S. Pat. No. 4,818,242; Konig et al. in U.S. Pat. No. 4,724,089; Konig et al. in U.S. Pat. No. 4,806,255; Dekker et al. in U.S. Pat. No. 4,661,267 and Trinh et al. in U.S. Pat. No. 4,661,269. A fabric softening composition containing emulsified silicone in combination with conventional cationic softening agents is also taught in Barrat et al. in U.S. Pat. No. 4,446,033. The aqueous compositions are used during the aqueous rinse cycle of a laundry process. Conditioning agents such as ion-pair wax composites have been used in detergent compositions by Caswell et al. in U.S. Pat. No. 4,913,828.

Unfortunately, it has been observed that the addition of either conventional silicone oils or certain organo-modified silicones in formulations used for coating dryer sheets, in the absence of a solvent, causes physical separation of the components of the compositions leading to uneven coating of sheet substrates.

Surprisingly, it has been found that specific organo-modified silicones function as emulsifiers for particular silicone oils in hydrocarbon based fabric conditioning formulations to form a stable fabric conditioning composition. The present invention eliminates the problem of physical separation of the composition's components leading to uneven coating of tumble dryer sheets. Furthermore, high levels of $H_2O$ or solvents are avoided in the invention which often lead to progressing difficulties and undesirable product attributes, such as tackiness or uneven coating of the sheets.

It is therefore an object of the present invention to provide an emulsified silicone mixture in combination with a fabric conditioning active to provide stable fabric conditioning compositions.

A further object of the present invention is to provide such emulsified silicone mixture/fabric conditioning compositions which provide improved softening and anti-static benefits when applied to fabrics in a tumble dryer.

A further object of the present invention is to provide a fabric conditioning composition which is stable when used in detergent formulations, even in those formulations containing harsh surfactants such as the alkyl sulfates.

SUMMARY OF THE INVENTION

The present invention relates to a fabric softening composition comprising:

(a) from about 60 to about 99 wt. percent of a fabric softening component; and (b) from about 1 to about 40 wt. percent of an emulsified mixture consisting essentially of (1) a silicone oil having a formula:

$$(CH_3)_3-SiO-(\underset{\underset{R}{|}}{\overset{\overset{CH_3}{|}}{Si}}O)_x-Si(CH_3)_3 \qquad (I)$$

wherein R is methyl, phenyl or C1–C5 alkyl and x is from 5 to 100,000, the silicone oil having a viscosity of from 10 to 1,000,000 centistokes, and (2) a silicone emulsifier having at least 1 of the following formulas:

$$(CH_3)_3-SiO-(\underset{\underset{CH_3}{|}}{\overset{\overset{CH_3}{|}}{Si}}O)_x-(\underset{\underset{R^1}{|}}{\overset{\overset{CH_3}{|}}{Si}}O)_y-Si(CH_3)_3 \qquad (II)$$

wherein $R^1$ is $$-R'-(C_2H_4O)_m-(C_3H_6O)_n-R^2;$$

R′ is a divalent hydrocarbon radical such as $$-(CH_2)_3- \text{ or } -(CH_2-\underset{\underset{CH_3}{|}}{CH}-CH_2);$$

$R^2$ is H,$CH_3$ or $COCH_3$; and x and y are each individually 1 or greater than 1 and the sum of x+y is up to about 10,000; m and n are individually 0, 1 or greater than 1 and the sum of m+n to about 300, and the silicone content of the compound of formula II is from about 1 to about 15 weight percent $$A-(B-A'-)_d \qquad III$$

wherein

A and A′ are each individually a randomly arranged block copolymer of $-(C_2H_4O)-$ and $-(C_3H_6O)-$, and d is 1 to 10,000 provided that when d is 1 A′ terminates with H, OH, methyl or an acyl group;

and B is

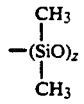

wherein z is 10 to 10,000, compounds of formula III having a silicone content of from about 1 to about 15 wt. percent or

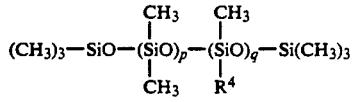

IV wherein $R^4$ is a linear or branched alkyl group having from 6 to 50 carbon atoms and is connected to the Si atom via a Si—O—C or a Si—C bond, or $R^4$ is a linear or branched alkyl-amino with p being 0 to about 10,000 and q being 1 to about 10,000 and the total sum of p+q being from about 2 to about 20,000, and the silicone content of formula IV being below about 65 wt. percent or.

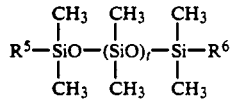

V wherein $R^5$ and $R^6$ are each individually a linear or branched alkyl group having 6 to 50 carbon atoms and $R^5$ and $R^6$ are attached to the Si atom via a C—Si bond or a C—O—Si bond; and t is from 1 to 10,000, the silicone content of formula V being below about 65 wt. percent, and mixtures of the silicone emulsifiers II–V thereof.

These fabric conditioning compositions may be applied to tumble dryer sheets or combined with detergent formulations.

DETAILED DESCRIPTION OF THE PREFERRED EMBODIMENTS

The components of the fabric conditioning compositions according to the invention are an emulsified silicone mixture comprised of a silicone oil and a silicone emulsifier compound combined with any conventional hydrocarbon fabric softener active known in the art.

The compositions within the scope of the invention exhibited less than 5% syneresis or phase separation and thus are useful in evenly coating tumble dryer articles or forming particles for use in liquid and powdered detergents.

The term "acyl" generally refers to a group —$COCH_3$ and the term "alkyl-amino" is described in U.S. Pat. No. 07/532,488 herein incorporated by reference.

The term "divalent hydrocarbon radical" refers to a group R' wherein R' is a hydrocarbon radical having from 1 to 45 carbon atoms, preferably 1 to 10 carbon atoms, which may be saturated, unsaturated, cyclic, acyclic, alkyl or aromatic. Preferred radicals include

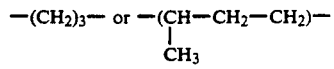

The components of the compositions are described in detail below. As used herein, the percentages are all by weight unless otherwise stated.

Emulsified Silicone Mixture

The emulsified silicone mixture is prepared by selecting particular silicone oils to combine with specific silicone emulsifiers to form a uniform mixture when added to a conventional hydrocarbon softener active base. Without being limited by theory, it is believed that the silicone emulsifier component migrates to the interface between the silicone oil and the hydrocarbon softener component to form a uniform and stable emulsified mixture.

Silicone Oil

The silicone oil component is a polydiorganosiloxane selected from the group of polydimethylsiloxanes, polyphenylmethylsiloxanes and polydiloweralkyl (C1–C5) siloxanes. The polydiorganosiloxane of the invention may be linear, branched or cyclic, and is preferably linear, having the formula

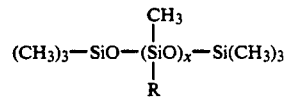

(I)

wherein R is methyl, phenyl or a C1–C5 alkyl; and x is from 5 to 100,000.

Silicone oils of formula I containing mixtures of a range of x are commercially available and classified on the basis of viscosity. The viscosity range for the invention is from 10 to 1,000,000 centistokes and preferably 100 to 10,000 centistokes.

Suitable non-limiting commercially available examples of linear silicone oils include: the DC 200 series owned by Dow Corning of Midland, Michigan and the L-45 series owned by Union Carbide of Danbury, Conn. Suitable examples of commercially available cyclic polydimethylsiloxanes include: DC 244 and DC 245 owned by Dow Corning.

Silicone Emulsifier Component

The silicone emulsifier component is selected from one of two types of organo-modified silicones, (a) silicone copolyols or (b) alkyl-modified silicones.

(A) Silicone Copolyols

Silicone copolyols, (also known as dimethicone copolyols) are classified as either graft copolymers or alternating block copolymers and have the following formulas:

i) graft copolymers

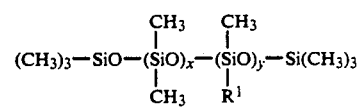

(II)

wherein $R^1$ is $$-R'-(C_2H_4O)m-(C_3H_6O)_n-R^2;$$

R' is a divalent hydrocarbon radical $R^2$ is H, $CH_3$ or $COCH_3$; and x and y are each individually 1 or greater than 1 and the sum of x+y is up to about 10,000; m and n are individually 0, 1 or greater than 1 and the sum of m+n is from 1 to about 300, and the silicone content of the compound of formula II is from about 1 to about 15 weight percent.

The silicone emulsifier component is further defined by its "silicone content". Silicone content is defined as the weight of the dimethylsiloxane backbone portion of the compound (s) divided by the weight of the molecule itself (m). This weight ratio may be calculated from the formula of the compound or may be ascertained from $^1H$ NMR spectrum of the molecule. The silicone content of (s/m) of the inventive component is preferably less than 1.

The silicone content of the silicone copolyols of formula II of the present invention is about 1 to about 15 weight percent and preferably about 1 to about 12 weight percent. The viscosity range of the silicone copolyols of formula II is from about 500 to about 5,000 centistokes, and preferably from about 500 to about 3,000 centistokes.

Particularly useful silicone copolyols of the graft copolymer type include the following commercially available copolymers:

| Silicone Copolyol (graft copolymer) | Silicone Content | Supplier |
|---|---|---|
| A | 12% | DC 190 by Dow Corning of Midland, MI |
| B | 15% | ABIL 8863 by Goldschmidt AG of Hopewell, VA |

ii) Silicone copolyols may also be alternating block copolymers. Such alternating block copolymers useful in the present invention have the formula:

$$A-(B-A'-)_d \qquad \text{III}$$

wherein

A and A' are each individually a randomly arranged block copolymer of $-(C_2H_4O)-$ and $-(C_3H_6O)-$, and d is 1 to 10,000 provided that when d is 1 A, terminates with H, OH, methyl or an acyl group;

and B is $$-\underset{\underset{CH_3}{|}}{\overset{CH_3}{|}}(SiO)_z$$

wherein z is 10 to 10,000.

Suitable commercially available alternating block silicone copolymers according to the invention are as follows:

Alkasil PR series owned by Rhone-Poulenc of France and PS 555 and 556 owned by Huls America of Bristol, Pa.

The silicone content of the alternating block copolymers of formula III is from about 1 to about 15 weight percent, preferably 1 to 12 weight percent.

(B) Alkyl-Modified Silicones

A second type of organo-modified silicone useful within the present invention are alkyl silicones. Alkyl silicones may also be classified as two general types: graft and end-blocked copolymers.

iii) The graft type of alkyl silicones have the formula:

$$(CH_3)_3-SiO-\underset{\underset{CH_3}{|}}{\overset{CH_3}{|}}(SiO)_p-\underset{\underset{R^4}{|}}{\overset{CH_3}{|}}(SiO)_q-Si(CH_3)_3 \qquad \text{IV}$$

wherein $R^4$ is a linear or branched alkyl chain having from 6 to 50 carbon atoms and is connected to the Si atom via a Si—O—C or a Si—C bond, or a linear or branched alkyl-amino with p being 0 to about 10,000 and q being 1 to 10,000 and the total sum of p+q being from about 2 to about 20,000 and the silicone content of formula IV being below about 65 wt. percent.

Examples of suitable graft alkylsilicones of formula IV of the present invention include the following:

| Graft Alkyl-Modified Silicone | Formula | Silicone Content |
|---|---|---|
| H | p = 100, q = 50, $R^4 = (CH_2)_{11}-CH_3$ | 36% |
| I | p = 95, q = 24, $R^4 = (CH_2)_{11}-CH_3$ | 48% |
| J | p = 100, q = 10, $R^4 = (CH_2)_{17}-CH_3$ | 57% |

The foregoing compounds are synthesized by a process described in U.S. Pat. No. 4,514,319 issued to Kulkanni et al. herein incorporated by reference.

Suitable commercially available graft alkyl silicones of formula IV are the ABIL waxes 9800 Series by Goldschmidt AG of Hopewell, Va.

A suitable graft alkyl silicone wherein x=0 is ABIL Wax 9810 owned by Goldschmidt AG.

The silicone content of the graft alkyl silicones should be below about 65 weight percent, preferably below about 50 weight percent and most preferably below 40 weight percent.

iv) A second type of suitable alkyl silicone for the invention are end-blocked alkyl silicones having the following formula:

$$R^5-\underset{\underset{CH_3}{|}}{\overset{CH_3}{|}}SiO-\underset{\underset{CH_3}{|}}{\overset{CH_3}{|}}(SiO)_t-\underset{\underset{CH_3}{|}}{\overset{CH_3}{|}}Si-R^6 \qquad \text{V}$$

wherein $R^5$ and $R^6$ are each individually a linear or branched alkyl group having 6 to 50 carbon atoms and $R^5$ and $R^6$ are attached to the Si atom via a C—Si bond or a C—O—Si bond; and t is from 1 to 10,000.

The silicone content of the end-blocked copolymers should be below about 65 weight percent, preferably below about 50 weight percent and most preferably below 40 weight percent.

It may be appreciated that the silicone emulsifier component of the present invention may be a single component or mixtures of the organo-modified silicones of formulas II–V described above. Additionally, it may be appreciated that any one of the types of organo-functionalities, (alkyl, alkylamino or polyol) combined in any of the molecular structures II–V (graft and alternating blocked) in a single molecule to form a component useful within the invention. Suitable commercially available silicone emulsifiers containing both a polyol and an alkyl functionality are ABIL EM-90 and ABIL WE-90 by Goldschmidt AG of Hopewell, Va.

The inventive compositions contain about 60 to about 99% of the hydrocarbon fabric softener active in combination with from about 1 to about 40% of the emulsified silicone mixture. Preferably, about 80 to about 99 weight percent of the fabric conditioning active is combined with about 1 to about 20 weight percent of the emulsified silicone mixture. In the emulsified mixture, the weight ratio of silicone emulsifier component to silicone oil should be from about 1/50 to 4/1, preferably from about 1/20 to 2/1 and most preferably from about 1/20 to 1/1.

Fabric Softener Component

Hydrocarbon fabric softeners suitable for use herein are selected from the following classes of compounds:

(i) Cationic quaternary ammonium salts. The counterion is methyl sulfate or any alkyl sulfate or any halide, methyl sulfate being preferred for the dryer-added articles of the invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated tallow)-dimethyl imidazolinium methylsulfate, 1-ethylene-bis(2-tallow-1-methyl) imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di(tallowoyl-oxy-ethyl)-N,N,-dimethyl ammonium methyl sulfate and N,N-di(tallowoyl-oxy-propyl)-N,N-dimethyl ammonium methyl sulfate. Biodegradable quaternary ammonium salts are described, for example in U.S. Pat. Nos. 4,137,180, 4,767,547 and 4,789,491 incorporated by reference herein.

Preferred biodegradable quaternary ammonium salts include the biodegradable cationic diester compounds of the formula:

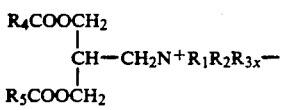

as described in U.S. Pat. No. 4,137,180, herein incorporated be reference.

(ii) Tertiary fatty amines having at least one and preferably two C8 to C30, preferably C12 to C22 alkyl chains. Examples include hardened tallow-di-methylamine and cyclic amines such as 1-(hydrogenated tallow-)amidoethyl-2-(hydrogenated tallow) imidazoline. Cyclic amines which may be employed for the compositions herein are described in U.S. Pat. No. 4,806,255 incorporated by reference herein.

(iii) Carboxylic acids having 8 to 30 carbons atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and palmitic acid, and mixtures thereof which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkylphenols, ethoxylated alkylphenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 the disclosure of which is incorporated by reference herein. Preferred fabric softeners for use herein are acyclic quaternary ammonium salts, di(hydrogenated)tallowdimethyl ammonium methylsulfate is most preferred for dryer articles of this invention.

The amount of the fabric softening composition on the sheet is subject to normal coating parameters such as, for example, viscosity and melting point of the fabric softening component and is typically about 0.5 grams to about 5 grams, preferably about 1 gram to about 3.5 grams. The fabric softening composition employed in the present invention contains about 0.1% to about 95% of the fabric softening component. Preferably form about 10% to about 80% and most preferably from about 30% to about 70% of the fabric softening component is employed herein to obtain optimum softening at minimum cost. When the fabric softening component includes a quaternary ammonium salts, the salt is used in the amount of about 10% to about 80%, preferably about 30% to about 70%.

Other Optional Fabric Conditioning Ingredients

Other optional ingredients which can be included in fabric conditioning compositions of the present invention in their conventional levels include optical brighteners or fluorescent agents, perfumes, colorants, germicides and bactericides. The general level of use of any such ingredients is 0 to about 10%.

Process of Preparation

The selected oil and silicone emulsifier components are emulsified with a hydrocarbon fabric softener active in a molten state stirred at a temperature range of about 50° to 200° C., preferably 50° to 150° C. and mixed to form a uniform mixture. The mixture is stirred until uniformity is achieved, generally about 15 minutes to about an hour.

Compositions which are useful in coating dispensing means for tumble dryer articles are processed in a conventional manner as described below.

To prepare detergent formulations with the inventive compositions, the uniform mixture is cast in its molten form into a container and allowed to solidify. The solid composition is then broken into chips which are cooled with dry ice in a blender and ground to a fine powder. The powder preferably has a particle size of less than about 500 microns. The resulting finely divided powder may be then incorporated with detergent actives and other detergent components to form a detergent conditioner formulation as more fully described and exemplified below.

The presence of volatile solvents, such as low molecular weight alcohols is generally deleterious to the processing of the compositions of the inventions. Problems ranging from separation of the components of the mixtures to accumulation of volatile vapors in laboratories and plants where processing performed occur. Such volatile solvents should be avoided and solvents or water which may be present in raw materials used to make the fabric softening active of the invention should be kept to a concentration of less than about 5% and preferably less than about 2% in the final mixtures.

Tumble Dryer Article

The conditioning composition of the present invention may be coated onto a flexible substrate which carries a fabric conditioning amount of the composition and is capable of releasing the composition at dryer operating temperatures. The conditioning composition in turn has a preferred melting (or softening) point of about 25° C. to about 150° C.

The fabric conditioning composition which may be employed in the invention is coated onto a dispensing means which effectively releases the fabric conditioning composition in a tumble dryer. Such dispensing means can be designed for single usage or for multiple uses. One such multi-use article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the inventive compositions releasably affixed to a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrates ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 5 mm to 50mm in length and are from 1.5 to 5 denier. Preferably, the fibers are at least partially oriented haphazardly, and are adhesively bonded together with a hydrophobic or substantially hydrophobic binder-resin. Preferably, the cloth comprises about 70% fiber and 30% binder resin polymer by weight and has a basis weight of from about 18 to 45g per square meter.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15 g/square yard. Passage of the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric conditioning composition employed in the present invention includes certain fabric softeners which can be used singly or in admixture with each other.

Detergent Formulations

It has been found that the conditioning compositions of the present invention can be incorporated into both granular and liquid detergent formulations with little detrimental effect on cleaning.

The compositions are typically used at levels up to about 30% of the detergent composition, preferably from about 5 to 20% of the detergent composition.

Detergent Surfactant

Detergent surfactant included in the detergent formulations of the invention may vary from 1% to abut 98% by weight of the composition depending on the particular surfactant(s) used and the cleaning effects desired.

Preferably, the surfactant is present in an amount of from about 10 to 60% by weight of the composition. Combinations of anionic, preferably alkyl sulfates, alkyl ethoxylated sulfates, linear alkyl benzene sulfonates, and nonionic, preferably alkyl polyethoxylated alcohol surfactants are preferred for optimum cleaning, softening and antistatic performance. It may be appreciated that other classes of surfactants such as ampholytic, zwitterionic or cationic surfactants may also be used as known in the art. As generally known, granular detergents incorporate the salt forms of the surfactants while liquid detergents incorporate the acid form where stable. Examples of surfactants within the scope of the invention are described in U.S. Pat. No. 4,913,828 issued to Caswell et al., herein incorporated by reference.

Builders, accumulating agents and soil release agents known in the art may also be used in the detergent formulations. Examples of suitable such components are described in Caswell et al., U.S. Pat. No. 4,913,828, herein incorporated by reference.

Other Optional Detergent Ingredients

Optional ingredients for the detergent compositions of the present invention other than those discussed above include hydrotropes, solubilizing agents, suds suppressers, soil suspending agents, corrosion inhibitors, dyes, fillers, optical brighteners, germicides, pH adjusting agents, enzyme stabilizing agents, bleaches, bleach activators, perfumes and the like.

EXAMPLES

The following examples illustrate without limitation the present invention.

EXAMPLE 1

This example demonstrates the effect of seven (7) silicone copolyol compounds as silicone emulsifiers in combination with a silicone oil and a hydrocarbon fabric softener agent according to the invention. The seven silicone copolyols which were tested are as follows:

TABLE 1

| Component | Silicone Content | Phase Separation & Syneresis | Supplier |
|---|---|---|---|
| None (control) | — | 83% | DC 190 by Dow Corning of Midland, MI |
| A | 12% | 0% | ABIL 8863 by Goldschmidt AG of Hopewell, VA |
| B | 15% | 4% | ABIL 8843 by Goldschmidt of Hopewell, VA |
| C | 19% | 18% | ABIL 8852 by Goldschmidt of Hopewell, VA |
| D | 19% | 35% | DC 193 by Dow Corning |
| E | 19% | 82% | DC 193 by Dow Corning |
| F | 25% | 82% | Magnasoft TLC by Union Carbide |
| G | 27% | 83% | ABIL 88184 by Goldschmidt of Hopewell, VA |

Each silicone emulsifier A–G was combined with a hydrocarbon fabric softener consisting of a mixture of di-hydrogenated tallow-di-methyl ammonium methyl sulfate (70% by weight) and a mixed fatty acid portion (30% by weight) including 70% stearic acid and 30% palmitic acid. A linear polydimethyl siloxane (350 Cst) of formula I (DC 200 by Dow Corning of Midland, Mich.) was selected as the silicone oil.

80% by weight of the hydrocarbon fabric softener mixture was blended with 10% by weight silicone oil and 10% by weight of one of the emulsifiers A–G by combining all the components in a beaker in a molten state. The molten mixture was stirred at 500 rpm for about 15 minutes with an overhead mixture fitted with a 2 inch mixing blade. A 100 gm conditioning composition was thus prepared.

As a control composition, 80% of the hydrocarbon fabric softener mixture was combined with 20% of the linear polydimethylsiloxane (350 Cst) as the silicone oil with no silicone emulsifier added. The control mixture was prepared in the same manner as the 7 experimental samples.

Twenty grams of each of the compositions A through G were placed in vials which were subsequently placed in an oven at a temperature of 95° C. 20 grams of the prepared control sample was also placed in a vial and the vial placed in an oven at the same temperature. Each sample was observed for phase separation and syneresis after 30 minutes. Syneresis was observed by the formation of a clear layer of hydrocarbon fabric softener compound on the top of vial. Phase separation of the silicone component from the composition was evidenced by the formation of a meniscus near the bottom of the vial. Both syneresis and phase separation was observed to occur in the same sample. Samples displaying phase separation or syneresis were unsuitable for coating on to sheets because uneven coating would result.

Compositions containing emulsifiers having 5% or less phase separation or syneresis are useful for coating dryer sheets or forming detergent particles and thus are within the scope of the invention.

EXAMPLE 2

In this example, a dryer sheet fabric conditioner article was prepared with a conditioning composition outside the scope of the invention. The purpose of the example is to point out that compositions outside the scope of the invention, specifically compositions containing traditional silicone oils but without silicone emulsifier, are unsuitable for coating onto sheets.

500 grams of a conditioning composition were prepared by blending 450 grams of a hydrocarbon softener (70% dihydrogenated tallow-di-methyl ammonium methylsulphate and 30% stearic acid) with 50 grams of a silicone oil (a linear polydimethylsiloxane, viscosity =350 CST) in the melt with stirring at 500 rpm for 15 minutes. The composition thus produced was placed in the melt in the coating pan of a two-roll coater and coated onto spun-bonded nonwoven polyester material. Due to the unstable nature of the composition, the silicone component separated from the hydrocarbon softener during the coating process. The sheets thus produced therefore contained unknown amounts of silicone. The unstable nature of compositions without silicone emulsifier thus renders them unsuitable for use, since articles of manufacture cannot be produced with consistent composition.

EXAMPLE 3

Five compositions containing a hydrocarbon conditioning mixture, a silicone oil and a silicone emulsifier were prepared. Specifically, the hydrocarbon mixture and the silicone oil of example 1 were combined with each of five different graft alkyl silicones as silicone emulsifiers having the following structures.

IV

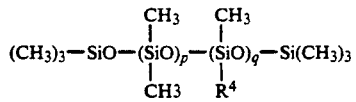

| Graft Alkyl-Modified Silicone | Formula | Silicone Content |
|---|---|---|
| H | $p = 100, q = 50, R^4 = (CH_2)_{11}—CH_3$ | 36% |
| I | $p = 95, q = 24, R^4 = (CH_2)_{11}—CH_3$ | 48% |
| J | $p = 100, q = 10, R^4 = (CH_2)_{17}—CH_3$ | 57% |
| K | $p = 100, q = 5, R^4 = (CH_2)_{17}—CH_3$ | 72% |
| L | $p = 400, q = 8, R^4 = (CH_2)_{17}—CH_3$ | 86% |

The compositions were prepared as described in example 1. A control sample was also prepared as described in example 1. Phase separation and syneresis of the composition samples were observed and the results are as follows:

TABLE 2

| Emulsifier | Silicone Content | % Separation |
|---|---|---|
| None (control) | — | 83 |
| H | 36 | 0 |
| I | 48 | 0.1 |
| J | 57 | 0.1 |
| K | 72 | 80 |
| L | 86 | 80 |

As stated in example 1, a phase separation or syneresis of less than 5% is within the scope of the invention. Therefore, emulsifiers H through J producing compositions having less than a 5% separation are within the scope of the invention. Emulsifiers K & L exhibited a large percentage of separation and syneresis and not useful in preparing the inventive compositions.

EXAMPLE 4

Two compositions containing the hydrocarbon mixture and the silicone oil of example 1 were prepared by adding one of two end-blocked alkyl silicones as silicone emulsifiers. The compositions were prepared as described in example 1 and observed for phase separation and syneresis. The results are as follows:

| Emulsifier | Percent Phase Separation and Syneresis |
|---|---|
| ABIL 2440* | 0 |
| ABIL 2434* | 80% |

*Supplied by Goldschmidt AG of Hopewell, VA

With the separation of less than 5% being within the invention scope, only the end-blocked alkyl silicone ABIL 2440 is within the scope of the invention. ABIL 2434 produced an 80% phase separation and thus was unsuitable for the present invention.

EXAMPLE 5

Two compositions were prepared with alternating block silicone copolyols as silicone emulsifiers in combination with the hydrocarbon fabric conditioning mixture and silicone oil described in Example 1. The compositions were also prepared as described in example 1 and phase separation and syneresis were observed as follows:

| Emulsifier | % Phase Separation and Syneresis |
|---|---|
| PS-555 | 82% |
| Alkasil PR S-127 | 40% |

Neither Alkasil PR S-127 causing about a 40% phase separation nor PS-555 with a phase separation of about 82% are within the scope of the invention. PS-555 has a silicone content of 50% by weight.

EXAMPLE 6

The following composition according to the invention was prepared as described in example 1:

| Ingredients | % by Weight |
|---|---|
| Di-hydrogenated tallow-di-methyl ammonium methyl sulphate | 63% |
| Fatty acids (70/30 stearic/palmitic acid) | 27% |
| Polydimethyl siloxane (silicone oil, viscosity = 350 cst) | 5% |
| Silicone emulsifier A* | 5% |

* = Silicone copolyol A of Table 1 of Example 1

The prepared composition were placed in its molten state in a coating pan of a two roll coating machine. The composition was then coated onto sheets of spunbonded polyester in a sufficient amount of provide approximately 1.6 grams of conditioning composition per sheet. The coated sheets were thus removed and were allowed to cool at room temperature solidifying the conditioning composition on the sheets.

Commercial product A (Snuggle ®) owned by Lever Brothers Company of NY, N.Y.) and Commercial product B (Bounce ®) owned by Procter & Gamble of Cincinnati, OH) were obtained.

A fabric bundle consisting of one yard square pieces of orlon, nylon, double-knit polyester sheeting and polyester/cotton pieces making a total of 3 lbs. was washed with a laundry detergent in an automatic washer with hot water and a normal cycle. The bundle was then placed in a tumble dryer, together with the tumble dryer sheet containing the composition according to the invention.

In comparison, identical fabric bundles were washed and placed in tumble dryers with control sheets containing the commercial product A and commercial product B.

The fabrics were removed from the dryer and their softness and anti-static effects were observed. Static effect was measured using a Simco electrostatic locator.

It was observed that the fabrics dried with sheets containing compositions according to the invention were superior in anti-static benefit to those of the commercial products A and B and when compared to drying without a sheet product at all.

EXAMPLE 7

A nonionic based powdered detergent including a softening composition according to the invention was prepared as follows:

The fabric softening composition was formed by blending in a melt the following ingredients:

| Ingredients | % by Weight |
|---|---|
| Di-hydrogenated tallow-di-methyl ammonium methyl sulphate | 58% |
| Sorbitan monostearate | 29% |
| Silicone oil[a] | 5% |
| Silicone emulsifier A[b] | 5% |
| Fragrance | 2% |
| Germicide | 1% |

[a]Linear polydimethylsiloxane DC 200 owned by Dow Corning of Midland, Michigan
[b]Silicone copolyol of example 1

The conditioning composition was cast in the melt into a pan and allowed to solidify. Chips of the composition were then cooled with dry ice in a Waring commercial blender and ground to a powder. The powder was sieved through a 500 micron screen and incorporated into a commercially available nonionic detergent composition, all ® owned by Lever Brothers Company of NY, N.Y.

One part of the conditioning composition was added to four parts of the detergent composition by hand mixing. The powder was observed to be free flowing and dispersed well in the wash cycle of a fabric laundering process.

EXAMPLE 8

An anionic powdered detergent including a conditioning composition according to the invention is prepared as follows:

Conditioning Composition

The following components are blended in the melt with stirring, without the addition of water or solvents:

| Ingredients | % by Weight |
|---|---|
| Sorbitan monostearate | 65% |
| Sorbitan tristearate | 10% |
| Di-stearyl-methyl amine | 9% |
| Silicone oil[a] | 5% |
| Silicone emulsifier A[b] | 5% |
| Fragrance | 4% |
| Germicide | 2% |

[a]Linear polydinmethylsiloxane DC 200 owned by Dow Corning of Midland Michigan.
[b]Silicone-co-polyol of Example 1.

The conditioning composition is cast in the melt into a pan and allowed to solidify. Chips of the composition are then cooled with dry ice in a Warming commercial blender and ground to a powder. The powder is sieved through a 500 micron screen and incorporated into a commercial anionic detergent having the formulation:

| | |
|---|---|
| Sodium allkylbenzene sulfonate | 12% |
| Sodium alkylsulfate | 8.5% |
| Nonionic surfactant[c] | 2.4% |
| Sodium polyacrylate | 2.9% |
| Sodium coco soap | 1.0% |
| Zeolite Builder (sodium aluminosilicate) | 31.4% |
| Sodium sulfate | 23.3% |
| Sodium carbonate | 14.2% |
| Sodium silicate | 1.7% |
| Water | 2.6% |

[c]Nonionic surfactant is a condensation product of myristic acid with 5 units of ethylene oxide.

The detergent formulation is prepared by hand mixing one part of the fabric conditioning composition with four parts of the anionic detergent base. The powder is free flowing and will disperse in the wash cycle of a fabric laundering process. Fabrics thus laundered with the detergent/softener composition will be soft and less static prone when compared to fabrics laundered with the detergent alone.

EXAMPLE 9

A heavy duty liquid detergent formulation including a fabric conditioning composition was prepared as follows.

A conditioning composition according to example 7 was prepared and incorporated into a commercially available heavy duty liquid detergent, Wisk® owned by Lever Brothers Company of NY, N.Y.

The heavy duty liquid detergent formulation was prepared by combining one part conditioning composition with four parts heavy duty liquid detergent. The composition was homogenized with an ultra Turrax homogenizer for three minutes. The resulting composition had a particle size of about 25 microns as determined with a Malvern Mastersizer particle size light scattering instrument. The prepared composition was stable for at least four weeks in a shelf storage test at 25° C.

EXAMPLE 10

A load of fabric consisting of 5 cotton terry towels and woven 50/50 polyester/cotton fabric totaling 6 lbs. by weight was washed in a commercial washing machine on a hot wash/cold rinse cycle with 135 grams of the detergent formulation of example 7. As a control, an identical load was washed in 135 grams of the commercially available nonionic detergent base of example 7.

At the completion of the rinse cycle, the load of fabrics was placed in a commercial tumble dryer and dried for a period of one hour. Upon removal from the tumble dryer, the fabrics treated with the detergent formulation according to the invention had superior softness and a low degree of static electricity. In comparison, the fabrics laundered with the detergent composition alone were harsh to the touch and static prone. To further demonstrate the efficacy of the detergent formulation of the invention, 20 blinded pair-comparisons between fabrics treated with the inventive detergent formulation and with the detergent alone were conducted. In 19 of 20 cases, the panelists rated the towels washed with the formulation according to the invention as softer than those washed with the detergent alone.

We claim:

1. A fabric conditioning composition comprising:

(a) from about 60 to about 99 wt. percent of a hydrocarbon based fabric conditioning component selected from the group consisting of a cationic quaternary ammonium salt, a tertiary fatty amine having at least one $C_8$ to $C_{30}$ alkyl chain, a carboxylic acid having 8 to 30 carbon atoms and one carboxylic group per molecule, an ester of a polyhydric alcohol, a fatty alcohol, an ethoxylated fatty alcohol, an alkyl phenol, an ethoxylated alkyl phenol, an ethoxylated fatty amine, an ethoxylated monoglyceride, and ethoxylated diglyceride, a mineral oil, a polyol and mixtures thereof; and (b) from about 1 to about 40 wt. percent of an emulsified mixture consisting essentially of (1) a silicone oil having a formula:

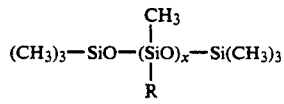

(I)

wherein R is methyl, phenyl or a $C_1$–$C_5$ alkyl and x is from 5 to 100,000, the silicone oil having a viscosity of from 10 to 1,000,000 centistokes, and (2) a silicone based nonionic emulsifier having at least 1 of formulas:

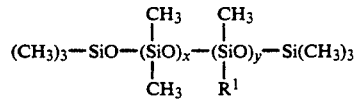

(II)

wherein $R^1$ is $$-R'-(C_2H_4O)_m-(C_3H_6O)_n-R^2;$$

R′ is a divalent hydrocarbon radical;

$R^2$ is H, $CH_3$ or $COCH_3$; and x and y are each individual 1 or greater than 1 and the sum of x+y is up to about 20,000; m and n are individually 0, 1 or greater than 1 and the sum of m+n is from 1 to about 300, and the silicone content of the compound of formula II is from about 1 to about 15 weight percent or $$A-(B-A'-)_d \qquad \text{III}$$

wherein

A and A′ are each individually a randomly arranged block copolymer of $-(C_2H_4O)-$ and $-(C_3H_6O)-$, and d is 1 to 10,000 provided that when d is 1 A′ terminates with H, OH, methyl or an acyl group;

and B is

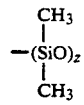

wherein z is 10 to 10,000, compounds of formula II having a silicone content of about 1 to about 15 wt. percent or

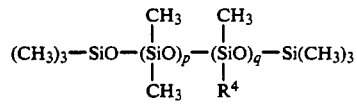

IV wherein $R^4$ is a linear or branched alkyl group having from 6 to 50 carbon atoms and connected to the Si atom via a Si—O—C or a Si—C bond, or $R^4$ is a linear or branched alkyl-amino with p being 0 to about 10,000 and q being 1 to 10,000 and the total sum of p+q being from about 2 to about 20,000, and the silicone content of formula IV being below about 65 wt. percent, or

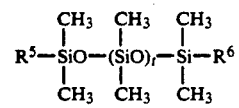

V wherein $R^5$ and $R^6$ are each individually a linear or branched alkyl group having 6 to 50 carbon atoms and $R^5$ and $R^6$ are attached to the Si atom via a C—Si bond or a C—O—Si bond; and t is from 1 to 10,000, the silicone content of formula V being below about 65 wt. percent, and mixtures of the silicone emulsifiers II–V thereof, the fabric conditioning composition being a stable non-aqueous composition having less than 5 wt. percent of water or an organic solvent.

2. The composition according to claim 1, comprising a weight ratio of the silicone emulsifier the silicone oil of formula I of from about 1/50 to 4/1.

3. The composition according to claim 2, wherein the the silicone emulsifier is a compound of formula II.

4. The composition according to claim 2, wherein the silicone emulsifier is a compound of formula IV.

5. The composition according to claim 4, wherein the silicone content of the silicone emulsifier of formula IV is less than 40 wt. percent.

6. The composition according to claim 1, comprising about 60 to about 99 wt. % of the fabric softening component and to about 20 wt. % of the emulsified mixture.

7. A tumble dryer article of manufacture for conditioning fabrics comprising:

a) a fabric softening composition comprising (i) from about 60 to about 99 wt. percent of a fabric softening component; and (ii) from about 1 to about 40 wt. percent of an emulsified mixture consisting essentially of (1) a silicone oil having a formula:

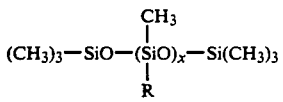

(I)

wherein R is methyl, phenyl or a C1–C5 alkyl and x is from 5 to 100,000, the silicone oil having a viscosity of from 10 to 1000,000 centistokes, and (2) a silicone emulsifier having at least 1 of formulas:

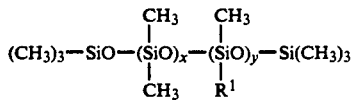

(II)

wherein $R^1$ is $$-R'-(C_2H_4O)_m-(C_3H_6O)_n-R^2;$$

R' is a divalent hydrocarbon radical $R^2$ is H,$CH_3$ or $COCH_3$; and x and y are each individually 1 or greater than 1 and the sum of x+y is up to about 20,000; m and n are individually 0, 1 or greater than 1 and the sum of m+n is from 1 to about 300, and the silicone content of the compound of formula II is from about 1 to about 15 weight percent or $$A-(B-A'-)_d \qquad \text{III}$$

wherein

A and A' are each individually a randomly arranged block copolymer of $-(C_2H_4O)-$ and $-(C_3H_6O)-$, and d is 1 to 10,000 provided that when d is 1 A, terminates with H, OH, methyl or an acyl group;

and B is

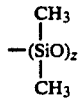

wherein z is 10 to 10,000, a compound of formula III having a silicone content of from about 1 to about 15. wt. percent or

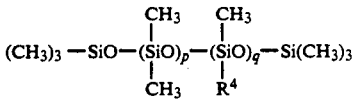

IV wherein $R^4$ is a linear or branched alkyl group having from 6 to 50 carbon atoms and connected to the Si atom via a Si—O—C or a Si—C bond, or $R^4$ is a linear or branched alkyl-amino with p being 0 to about 10,000 and q being 1 to 10,000 and the total sum of p+q being from about 2 to about 20,000, and the silicone content a compound of formula IV being from less than about 65 wt. percent

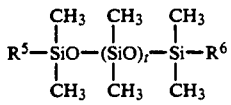

V wherein $R^5$ and $R^6$ are each individually a linear or branched alkyl group having 6 to 50 carbon atoms and $R^5$ and $R^6$ are attached to the Si atom via a C—Si bond or a C—O—Si bond; and t is from 1 to 10,000, the silicone content of a compound of formula V being less than about 65 wt. percent and mixtures of the silicone emulsifiers II–V thereof; and (b) dispensing means.

8. A tumble dryer sheet according to claim 7, comprising a weight ratio of the silicone emulsifier the silicone oil of formula I of from about 1/50 to 4/1.

9. A tumble dryer sheet according to claim 8, wherein the silicone emulsifier is a compound of formula II.

10. The composition according to claim 8, wherein silicone emulsifier is a compound of formula IV.

11. The composition according to claim 10, wherein the silicone content of the silicone emulsifier of formula IV is less than about 40% by weight.

12. The tumble dryer article of claim 7, wherein the fabric softening active is a cationic quaternary ammonium salt selected from the group consisting of a cyclic quaternary ammonium salts having at least two C8–30 alkyl chains, quaternary imidazolinium salts, diamido quaternary ammonium salts, biodegradable quaternary ammonium salts and mixtures thereof.

13. The tumble dryer article of claim 7, wherein the dispensing means is a flexible substrate.

14. The tumble dryer article of claim 13, wherein the flexible substrate is in a sheet configuration.

15. A detergent formulation for use in a laundering process comprising:

(a) from about 1% to about 99% of a water soluble detergent surfactant selected from the group consisting of nonionic surfactants which are not silicone based, zwitterionic surfactants, amphoteric surfactants, anionc surfactants and mixtures thereof;

(b) about 1 to about 20 percent fabric conditioning composition comprising:

(i) about 60 to about 99% of a fabric conditioning active, selected from the group consisting of a cationic quaternary ammonium salt, a tertiary fatty amine having at least one $C_8$ to $C_{30}$ alkyl chain, a carboxylic acid having 8 to 30 carbon atoms and one carboxylic group per molecule, an ester of a polyhydric alcohol, a fatty alcohol, an ethoxylated fatty alcohol, an alkyl phenol, an ethoxylated alkyl phenol, an ethoxylated fatty amine, an ethoxylated monoglyceride, an ethoxylated diglyceride, a mineral oil, a polyol and mixtures thereof; and (ii) about 1 to about 40% of a silicone based emulsified mixture according to claim 1; and (c) from about 5 to about 50% of a detergency builder, the detergent formulation being a non-aqueous composition having less than 5 wt. percent of water or an organic solvent.

16. A process of making a fabric conditioning composition comprising:

(a) selecting a hydrocarbon based fabric conditioning active from the group consisting of from about 60 to about 99 wt. percent of a hydrocarbon based fabric conditioning component selected from the group consisting of a cationic quaternary ammonium salt, a tertiary fatty amine having at least one $C_8$ to $C_{30}$ alkyl chain, a carboxylic acid having 8 to 30 carbon atoms and one carboxylic group per molecule, an ester of a polyhydric alcohol, a fatty alcohol, an ethoxylated fatty alcohol, an alkyl phenol, an ethoxylated alkyl phenol, an ethoxylated fatty amine, an ethoxylated monoglyceride, an ethoxylated diglyceride, a mineral oil, a polyol and mixtures thereof;

(b) selecting a silicone oil of formula $$(CH_3)_3-SiO-(\underset{\underset{R}{|}}{\overset{\overset{CH_3}{|}}{Si}}O)_x-Si(CH_3)_3 \qquad (I)$$

wherein R is methyl, phenyl or a C1-C5 alkyl and x is from 5 to 100,000, the silicone oil having a viscosity of from 10 to 1,000,000 centistokes:

(c) choosing a silicone emulsifier component having one of the following formulas:

$$(CH_3)_3-SiO-(\underset{\underset{CH_3}{|}}{\overset{\overset{CH_3}{|}}{Si}}O)_x-(\underset{\underset{R^1}{|}}{\overset{\overset{CH_3}{|}}{Si}}O)_y-Si(CH_3)_3 \qquad (II)$$

wherein $R^1$ is $$-R'-(C_2H_4O)_m-(C_3H_6O)_n-R^2;$$

R' is a divalent hydrocarbon radical;

$R^2$ is H, $CH_3$ or $COCH_3$; and x and y are each individually 1 or greater than 1 and the sum of X+y is up to about 20,000; m and n are individually 0, 1 or greater than 1 and the sum of m+n is from 1 to about 300, and the silicone content of the compound of formula II is from about 1 to about 15 weight percent or $$A-(B-A'-)_d \qquad III$$

wherein

A and A' are each individually a randomly arranged block copolymer of $-(C_2H_2O)-$ and $-(C_3H_6O)-$, and d is 1 to 10,000 provided that when d is 1 A' terminates with H, OH, methyl or an acyl group;

and B is $$-(\underset{\underset{CH_3}{|}}{\overset{\overset{CH_3}{|}}{Si}}O)_z$$

wherein z is 10 to 10,000, a compound of formula III having a silicone content of less than about 15 wt. percent or $$(CH_3)_3-SiO-(\underset{\underset{CH_3}{|}}{\overset{\overset{CH_3}{|}}{Si}}O)_p-(\underset{\underset{R^4}{|}}{\overset{\overset{CH_3}{|}}{Si}}O)_q-Si(CH_3)_3 \qquad IV$$

wherein $R^4$ is a linear or branched alkyl group having from 6 to 50 carbon atoms and connected to the Si atom via Si—O—C or a Si—C bond, or $R^4$ is a linear or branched alkyl-amino with p being 0 to about 10,000 and q being 1 'to 10,000 and the total sum of p+q being from about 2 to about 20,000, and the silicone content of a compound of formula IV being less than about 65 wt. percent or $$R^5-\underset{\underset{CH_3}{|}}{\overset{\overset{CH_3}{|}}{Si}}O-(\underset{\underset{CH_3}{|}}{\overset{\overset{CH_3}{|}}{Si}}O)_t-\underset{\underset{CH_3}{|}}{\overset{\overset{CH_3}{|}}{Si}}-R^6 \qquad V$$

wherein $R^5$ and $R^6$ are each individually a linear or branched alkyl group having 6 to 50 carbon atoms and $R^5$ and $R^6$ are attached to the Si atom via a C—Si bond or a C—O—Si bond; and t is from 1 to 101000, the silicone content of a compound of formula V being less than about 65 wt. percent, and mixtures of the silicone emulsifiers II-V thereof; and (d) blending together the selected fabric softening component of step (a), the silicone oil of step (b) and the silicone emulsifier of step (c) to form a uniform molten mixture of the composition which is a stable nonaqueous composition having less than 5 wt. % of water or an organic solvent.

17. A fabric conditioning composition according to claim 1, wherein the stable non-aqueous composition has less than about 2 wt. % of water or an organic solvent.

18. A detergent formulation according to claim 15, wherein the non-aqueous composition has less than about 2 wt. % of the water or the organic solvent.

19. A process according to claim 16, wherein the non-aqueous composition has less than about 2 wt. % of the water or the organic solvent.

* * * * *